US007322761B2

(12) United States Patent
Silverbrook et al.

(10) Patent No.: US 7,322,761 B2
(45) Date of Patent: Jan. 29, 2008

(54) SPOOL ADAPTED FOR GRIPPING A ROLL OF PRINT MEDIA

(75) Inventors: Kia Silverbrook, Balmain (AU); Nagesh Ramachandra, Balmain (AU); Jan Waszczuk, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 0 days.

(21) Appl. No.: 11/223,022

(22) Filed: Sep. 12, 2005

(65) Prior Publication Data

US 2007/0059081 A1 Mar. 15, 2007

(51) Int. Cl.
*B41J 11/00* (2006.01)
*B41J 15/00* (2006.01)
*B65H 75/24* (2006.01)

(52) U.S. Cl. ..... 400/614; 400/613; 242/571; 242/571.3; 242/571.4; 242/571.8

(58) Field of Classification Search ..... 242/571.8, 242/571, 596.4, 599.1, 571.4, 571.3; 400/242, 400/243, 244, 236.2
See application file for complete search history.

(56) References Cited

U.S. PATENT DOCUMENTS

| | | | | |
|---|---|---|---|---|
| 2,647,701 | A * | 8/1953 | Cannard | 242/571.8 |
| 3,166,335 | A * | 1/1965 | Mason | 242/571.8 |
| 3,721,398 | A * | 3/1973 | Azzalin et al. | 242/532.5 |
| 3,881,666 | A * | 5/1975 | Greenhalgh | 242/571.3 |
| 4,422,590 | A * | 12/1983 | Rathbone | 242/571.8 |
| 5,255,862 | A * | 10/1993 | Chenest | 242/571.8 |
| 5,354,010 | A * | 10/1994 | Loos | 242/571.8 |
| 5,529,410 | A | 6/1996 | Hunter et al. | |
| 5,547,298 | A * | 8/1996 | Wouters et al. | 400/692 |
| 5,820,279 | A | 10/1998 | Lodwig et al. | |
| 5,884,860 | A * | 3/1999 | Ishikawa et al. | 242/422 |
| 5,911,382 | A * | 6/1999 | Wilson | 242/419.6 |
| 6,491,252 | B2 * | 12/2002 | Komatsu et al. | 242/596.1 |
| 6,641,314 | B2 | 11/2003 | Mogi | |
| 6,799,913 | B2 | 10/2004 | Ono et al. | |
| 2002/0126298 | A1 * | 9/2002 | Galan et al. | 358/1.3 |

FOREIGN PATENT DOCUMENTS

| | | | |
|---|---|---|---|
| JP | 08002078 | A | 1/1996 |
| JP | 08002821 | A | 1/1996 |
| JP | 2000033720 | A | 2/2000 |

* cited by examiner

*Primary Examiner*—Ren Yan
*Assistant Examiner*—Matthew Marini

(57) ABSTRACT

A spool, such as supply for a wide-format printer, is provided. The spool comprises a spindle for slidingly receiving an outer shaft, which is typically the core of a roll of print media. A first resiliently deformable gripping ring is circumferentially mounted about the spindle, and a compression mechanism is provided for axially compressing the gripping ring. The axial compression causes radial expansion of the gripping ring, thereby urging the gripping ring into gripping engagement with the outer shaft received on the spindle.

13 Claims, 7 Drawing Sheets

SPOOL ADAPTED FOR GRIPPING A ROLL OF PRINT MEDIA

FIELD OF THE INVENTION

The present invention relates to a spool for a printer, such as a supply spool. It has been developed primarily to allow facile loading and unloading of a roll of print media into a wide format printer, whilst ensuring minimal slippage of the roll during printing.

CO-PENDING APPLICATIONS

The following applications have been filed by the Applicant simultaneously with the present application:

| | | | | | |
|---|---|---|---|---|---|
| 11/223021 | 11/223020 | 11/223019 | 11/223262 | 11/223018 | 11/223114 |

The disclosures of these co-pending applications are incorporated herein by reference.

CROSS REFERENCES TO RELATED APPLICATIONS

Various methods, systems and apparatus relating to the present invention are disclosed in the following co-pending applications filed by the applicant or assignee of the present invention. The disclosures of all of these co-pending applications and granted patents are incorporated herein by cross-reference.

| | | | | | | |
|---|---|---|---|---|---|---|
| 09/517539 | 6566858 | 09/112762 | 6331946 | 6246970 | 6442525 | 09/517384 |
| 09/505951 | 6374354 | 09/517608 | 6816968 | 6757832 | 6334190 | 6745331 |
| 09/517541 | 10/203559 | 10/203560 | 10/203564 | 10/636263 | 10/636283 | 10/866608 |
| 10/902889 | 10/902833 | 10/940653 | 10/942858 | 10/727181 | 10/727162 | 10/727163 |
| 10/727245 | 10/727204 | 10/727233 | 10/727280 | 10/727157 | 10/727178 | 10/727210 |
| 10/727257 | 10/727238 | 10/727251 | 10/727159 | 10/727180 | 10/727179 | 10/727192 |
| 10/727274 | 10/727164 | 10/727161 | 10/727198 | 10/727158 | 10/754536 | 10/754938 |
| 10/727227 | 10/727160 | 10/934720 | 10/296522 | 6795215 | 10/296535 | 09/575109 |
| 6805419 | 6859289 | 09/607985 | 6398332 | 6394573 | 6622923 | 6747760 |
| 6921144 | 10/884881 | 10/943941 | 10/949294 | 11/039866 | 11/123011 | 11/123010 |
| 11/144769 | 11/148237 | 10/922846 | 10/922845 | 10/854521 | 10/854522 | 10/854488 |
| 10/854487 | 10/854503 | 10/854504 | 10/854509 | 10/854510 | 10/854496 | 10/854497 |
| 10/854495 | 10/854498 | 10/854511 | 10/854512 | 10/854525 | 10/854526 | 10/854516 |
| 10/854508 | 10/854507 | 10/854515 | 10/854506 | 10/854505 | 10/854493 | 10/854494 |
| 10/854489 | 10/854490 | 10/854492 | 10/854491 | 10/854528 | 10/854523 | 10/854527 |
| 10/854524 | 10/854520 | 10/854514 | 10/854519 | 10/854513 | 10/854499 | 10/854501 |
| 10/854500 | 10/854502 | 10/854518 | 10/854517 | 10/934628 | 10/728804 | 10/728952 |
| 10/728806 | 10/728834 | 10/728790 | 10/728884 | 10/728970 | 10/728784 | 10/728783 |
| 10/728925 | 10/728842 | 10/728803 | 10/728780 | 10/728779 | 10/773189 | 10/773204 |
| 10/773198 | 10/773199 | 6830318 | 10/773201 | 10/773191 | 10/773183 | 10/773195 |
| 10/773196 | 10/773186 | 10/773200 | 10/773185 | 10/773192 | 10/773197 | 10/773203 |
| 10/773187 | 10/773202 | 10/773188 | 10/773194 | 10/773193 | 10/773184 | 11/008118 |
| 11/060751 | 11/060805 | 11/188017 | 6623101 | 6406129 | 6505916 | 6457809 |
| 6550895 | 6457812 | 10/296434 | 6428133 | 6746105 | 10/407212 | 10/407207 |
| 10/683064 | 10/683041 | 6750901 | 6476863 | 6788336 | 11/097308 | 11/097309 |
| 11/097335 | 11/097299 | 11/097310 | 11/097213 | 11/097212 | 10/760272 | 10/760273 |
| 10/760187 | 10/760182 | 10/760188 | 10/760218 | 10/760217 | 10/760216 | 10/760233 |
| 10/760246 | 10/760212 | 10/760243 | 10/760201 | 10/760185 | 10/760253 | 10/760255 |
| 10/760209 | 10/760208 | 10/760194 | 10/760238 | 10/760234 | 10/760235 | 10/760183 |
| 10/760189 | 10/760262 | 10/760232 | 10/760231 | 10/760200 | 10/760190 | 10/760191 |
| 10/760227 | 10/760207 | 10/760181 | 10/815625 | 10/815624 | 10/815628 | 10/913375 |
| 10/913373 | 10/913374 | 10/913372 | 10/913377 | 10/913378 | 10/913380 | 10/913379 |
| 10/913376 | 10/913381 | 10/986402 | 11/172816 | 11/172815 | 11/172814 | 11/003786 |
| 11/003354 | 11/003616 | 11/003418 | 11/003334 | 11/003600 | 11/003404 | 11/003419 |
| 11/003700 | 11/003601 | 11/003618 | 11/003615 | 11/003337 | 11/003698 | 11/003420 |
| 11/003682 | 11/003699 | 11/071473 | 11/003463 | 11/003701 | 11/003683 | 11/003614 |
| 11/003702 | 11/003684 | 11/003619 | 11/003617 | 10/760254 | 10/760210 | 10/760202 |
| 10/760197 | 10/760198 | 10/760249 | 10/760263 | 10/760196 | 10/760247 | 10/760223 |
| 10/760264 | 10/760244 | 10/760245 | 10/760222 | 10/760248 | 10/760236 | 10/760192 |
| 10/760203 | 10/760204 | 10/760205 | 10/760206 | 10/760267 | 10/760270 | 10/760259 |
| 10/760271 | 10/760275 | 10/760274 | 10/760268 | 10/760184 | 10/760195 | 10/760186 |
| 10/760261 | 10/760258 | 11/014764 | 11/014763 | 11/014748 | 11/014747 | 11/014761 |
| 11/014760 | 11/014757 | 11/014714 | 11/014713 | 11/014762 | 11/014724 | 11/014723 |
| 11/014756 | 11/014736 | 11/014759 | 11/014758 | 11/014725 | 11/014739 | 11/014738 |
| 11/014737 | 11/014726 | 11/014745 | 11/014712 | 11/014715 | 11/014751 | 11/014735 |
| 11/014734 | 11/014719 | 11/014750 | 11/014749 | 11/014746 | 11/014769 | 11/014729 |
| 11/014743 | 11/014733 | 11/014754 | 11/014755 | 11/014765 | 11/014766 | 11/014740 |
| 11/014720 | 11/014753 | 11/014752 | 11/014744 | 11/014741 | 11/014768 | 11/014767 |
| 11/014718 | 11/014717 | 11/014716 | 11/014732 | 11/014742 | 11/097268 | 11/097185 |
| 11/097184 | 09/575197 | 09/575195 | 09/575159 | 09/575132 | 09/575123 | 6825945 |
| 09/575130 | 09/575165 | 6813039 | 09/575118 | 09/575131 | 09/575116 | 6816274 |
| 09/575139 | 09/575186 | 6681045 | 6728000 | 09/575145 | 09/575192 | 09/575181 |
| 09/575193 | 09/575156 | 6789194 | 09/575150 | 6789191 | 6644642 | 6502614 |

-continued

| | | | | | | |
|---|---|---|---|---|---|---|
| 6622999 | 6669385 | 6549935 | 6727996 | 6591884 | 6439706 | 6760119 |
| 09/575198 | 6290349 | 6428155 | 6785016 | 6870966 | 6822639 | 6737591 |
| 09/575154 | 09/575129 | 6830196 | 6832717 | 09/575189 | 09/575162 | 09/575172 |
| 09/575170 | 09/575171 | 09/575161 | | | | |

BACKGROUND OF THE INVENTION

In general, there are two methods of feeding print media (e.g. paper) past a printhead in a printer. Desktop printers typically feed individual sheets of paper from a stack of paper held in a paper tray. Individual sheets of paper are taken from the top of the stack on demand and fed past the printhead.

In large-scale wide format printing, the print media is typically a continuous web. The web of print media is supplied as, for example, a roll of paper, which can be fitted onto a supply spool in the printer. During printing, the web is fed from the supply spool, past a printhead and onto a take-up spool. Usually, a drive roller system, comprised of a pair of grippingly engaged rollers, is positioned between the supply spool and the take-up spool. The drive roller system feeds the web past the printhead on demand.

In all commercially available wide format printers, a scanning printhead is employed to deposit ink on the web of print media. In such printers, the web must be stationary as the printhead traverses across the web. After each scan of the printhead, the web moves forward and the printhead scans across again, depositing the next line of an image.

U.S. Pat. No. 6,672,706 (Silverbrook) describes a wide format pagewidth inkjet printer. In this wide format pagewidth printer, the web is continuously fed past a pagewidth printhead. The pagewidth printhead makes high-speed wide format printing possible by "printing-on-the-fly"—that is, continuously feeding a web and simultaneously printing without the web having to be stationary at any stage.

It will be appreciated that, in order to achieve "printing-on-the-fly", it is important that the delivery of the media is finely controlled to achieve consistent print quality. Any variation in web speed or web tension would result in a deterioration in print quality in the form of, for example, a distorted printed image. A constant web speed and web tension requires not only a reliable feed motor system, but also secure attachment of the web between the supply spool and the take-up spool. It is particularly important to avoid slippage of the supply spool when the web is under tension, otherwise a loss of tension and poor print quality may result.

In general, print media for wide format printers are supplied as rolled webs having a hollow cardboard core. These rolls of print media are usually loaded into wide format printers by threading a spindle (or axle) through the hollow cardboard core. The spindle is then loaded into the printer by connecting it to suitable end-mountings, which cooperate with the spindle to form a supply spool. The roll of print media is free to rotate allowing the web to be fed to drive rollers. The drive rollers draw print media from the supply spool, feed it past a printhead, and then onto a take-up spool driven by a take-up motor.

When "printing-on-the-fly" at high speeds, it is especially important to keep the web of print media under tension at all times. Any sagging between the drive rollers and the supply spool may result in crumpling of the print media when the printer is being run at high speeds. Accordingly, in continuous high-speed wide format printing, the supply spool is usually connected to a braking motor, which opposes the natural rotation of the supply spool. This natural rotation of the supply spool is a result of the drive rollers drawing the web from the supply spool. The braking motor provides a counter-rotational force, which generates tension in the web between the supply spool and the drive rollers. A problem with the traditional supply spool arrangement described above is that the cardboard core of the rolled web tends to slip over the spindle when a braking force is applied to the spindle, thereby diminishing the effect of any braking force applied.

It would be desirable to provide a spool, such as a supply spool for a printer, which minimizes slippage of the rolled web of print media relative to a spindle on which it is mounted. It would be particularly desirable to maximize transmission of a force from a braking motor to a roll of print media so that tension in the web can be generated and accurately controlled.

SUMMARY OF THE INVENTION

In a first aspect, the present invention provides a spool for a printer, said spool comprising:

- a spindle for slidingly receiving an outer shaft, said spindle having first and second ends; and
- a first resiliently deformable gripping ring circumferentially mounted about said spindle; and
- a compression mechanism for axially compressing said gripping ring, wherein said axial compression causes radial expansion of said gripping ring, thereby urging said gripping ring into gripping engagement with said outer shaft received on said spindle.

In a second aspect, the present invention provides a printer comprising:

- a printhead; and
- a feed mechanism for feeding a web of print media past the printhead, the feed mechanism comprising:
  - a supply spool;
  - a take-up spool; and
  - a take-up motor operatively connected to said take-up spool, wherein the supply spool and/or the take-up spool is a spool as defined above.

An advantage of the present invention is that the gripping ring(s) mounted on the spindle are adapted for gripping engagement with an outer shaft, which is usually the cardboard core of a roll of print media. Specifically, the gripping rings are radially expandable to maximize gripping engagement and thereby minimize rotation of the spindle relative to the roll of print media. Gripping engagement is achieved by any suitable grips on the gripping rings, such as friction grips formed from rubber, plastics and the like; biting grips formed from teeth; or clawing grips formed from claws. When used as a supply spool, the gripping engagement allows the spool to transmit reliably a counter-rotational force to the roll of print media when the spool is rotating freely. A counter-rotational force may be applied to the spool by a braking motor operatively connected to one end of the spool. As mentioned above, the use of a braking motor is especially important in high-speed wide format printing for minimizing print media crumpling between the supply spool and the drive rollers.

The advantages of the present invention are fully realized when the spool is used as a supply spool. However, the spool of the present invention may also be used as a take-up spool, if desired. For example, the spindle may receive an "empty" cardboard shaft to which the gripping rings can be grippingly engaged. With a leading edge of a web of print media fastened to this cardboard shaft, the spool may be used as take-up spool in a printer. Such an arrangement is advantageous, because it is important to avoid slippage in the take-up spool as well as in the supply spool during high-speed printing. Hence, whilst the spool of the present invention will be described primarily as a supply spool with reference to a roll of print media, it will be readily appreciated that the spool may also be used as a take-up spool.

The spindle may have a plurality of gripping rings mounted thereon. Optionally, the spool comprises a pair of gripping rings, each being radially expandable and mounted at respective ends of the spindle. The use of a pair of gripping rings advantageously maximizes traction between the spindle and the roll of print media. This is especially important in elongate spindles, which are typically used in wide-format printing.

Optionally, the gripping rings are radially expandable by compression. It will be readily apparent that a compression force acting on the annular surface(s) of a ring will tend to cause radial expansion of the ring. Accordingly, the gripping rings are optionally formed from a resiliently deformable material, such as rubber. The gripping rings are typically mounted on the spindle in coaxial alignment therewith. Hence, a longitudinal compression force, acting along the spindle, on the annular surface of the gripping ring will generally cause radial expansion of the ring. This compression may be conveniently provided by, for example, engagement of an end-plate with the spindle.

Optionally, the gripping rings are formed from a frictional material for frictional gripping engagement with a roll of print media. As mentioned above, commercially available rolls of print media typically have a cardboard core and the gripping rings are advantageously formed from a material, which provides a complementary frictional gripping engagement with cardboard. Optionally, the gripping rings are formed from rubber, which is resiliently deformable under compression and which grips cardboard with sufficient traction to minimize slippage.

Optionally, the spool comprises a compression mechanism for compressing the gripping ring(s). The skilled person will be able to envisage many different types of compression mechanisms, which may be used for compressing and, hence, radially expanding the gripping ring(s). One form of the spool according to the present invention comprises:

- a thrust end-plate releasably engageable with the first end of the spindle;
- a first abutment surface, positioned towards the first end of the spindle, for providing a reaction against the thrust end-plate; and
- a first gripping ring mounted between the thrust end-plate and the first abutment surface, wherein, upon thrusting engagement of the thrust end-plate with the spindle, the first gripping ring is compressed against the first abutment surface.

This form of the spool advantageously compresses the gripping ring when the end-plate engages with the spindle. Hence, as the spool is assembled with a roll or print media received thereon, the gripping ring is brought into gripping engagement with the roll of print media by engagement of the thrust end-plate. In other words, the user is not required to perform any separate operation in order to achieve radial expansion of the gripping ring—this is achieved simultaneously with assembly of the spool.

The thrust end-plate is typically releasably engageable to allow a roll of print media to be slid on and off the spindle, as required. Releasable engagement may be by means of threaded engagement, friction-fitting engagement, snap-lock engagement, bayonet engagement etc. Optionally, the first end of the spindle is threaded and the thrust end-plate is threadedly engaged therewith. Threaded engagement is advantageous, because it provides secure fastening, facile design/construction and facile assembly of the spool by a screwing action, which gradually compresses and expands the gripping ring.

The first abutment surface may be formed on, for example, a circumferential flange or a collar mounted on the spindle. Optionally, the first abutment surface is formed on a collar and the first gripping ring bears against an annular end surface of the collar.

Optionally, the spool further comprises a first washer positioned between the first gripping ring and the thrust end-plate. The washer distributes evenly a compression force from the thrust end-plate onto the first gripping ring. The washer typically takes the form of an annular ring having an annulus of similar dimensions to the annulus of the first gripping ring and the collar. Furthermore, the thrust end-plate typically comprises an annular thrusting projection having an annulus of similar dimensions to the annulus of the first washer. This annular thrusting projection, in combination with the first washer, advantageously transmits a maximum compression force onto the first gripping ring, which bears against the first abutment surface. In this way, maximum radial expansion of the first gripping ring may be achieved when the thrust end-plate engages with the spindle.

As mentioned above, the spool optionally comprises a pair of gripping rings, each of which is radially expandable by compression. Optionally, both gripping rings will be compressed simultaneously by the compression mechanism, and optionally in a manner which involves minimal user effort. Accordingly, the spool may further comprise:

- an inner shaft telescopically engaged in the spindle, the inner shaft having first and second ends corresponding to the first and seconds ends of the spindle;
- at least one lug projecting radially outwards from the inner shaft, the at least one lug being longitudinally slidingly engaged in a complementary longitudinal slot in the spindle;
- a second abutment surface, positioned at a second end of the spindle, for providing a reaction against the at least one lug; and
- a second gripping ring mounted between the at least one lug and the second abutment surface, wherein, upon longitudinal sliding of the inner shaft relative to the spindle, the second gripping ring is compressed against the second abutment surface by the at least one lug.

This form of the spool provides compression, and therefore radial expansion, of the second gripping ring by longitudinally sliding an inner shaft. This advantageously obviates the need for a removable end-plate at the second end of the spindle. With a permanent end-plate at the second end, the spindle can be operatively connected to a motor without having to disconnect both end-plates each time the roll of print media needs changing. Hence, this compression mechanism advantageously allows a simple process for exchanging a spent roll of print media for a fresh one.

The inner shaft is typically longer than the spindle such that both its ends protrude from the spindle. Accordingly, support mountings may be connected to either end of the inner shaft for fitting the spool in a printer.

The engagement of the lug(s) with their complementary longitudinal slots in the spindle inhibits rotation of the inner shaft relative to the spindle. However, a degree of longitudinal sliding is permitted by the longitudinal slot(s), thereby allowing compression of the second gripping plug by the lug(s) against the second abutment surface. Optionally, the inner shaft comprises a pair of diametrically opposed lugs, each being slidingly engaged in a respective complementary longitudinal slot in the spindle. Diametrically opposed lugs ensure greater security with the spindle and more even distribution of the compression force generated by relative longitudinal sliding.

The second abutment surface may be formed on, for example, a circumferential flange, a collar or a circumferential lip. Optionally, the second abutment surface is formed on a circumferential lip at the second end of the spindle, and the second gripping ring bears against the annular surface of the lip.

Optionally, the spool further comprises a second washer positioned between the second gripping ring and the lugs. The washer distributes evenly a compression force from the lugs onto the second gripping ring. The washer typically takes the form of an annular ring having an annulus of similar dimensions to the annulus of the second gripping ring and the lip. In this way, maximum radial expansion of the second gripping ring may be achieved when the lugs exert a compression force on the second washer and, thence, the second gripping ring, which bears against the lip.

Optionally, the relative longitudinal sliding is telescopic expansion of the inner shaft relative to the spindle. Optionally, this telescopic expansion is caused by engagement of the thrust end-plate with the first end of the spindle. Such telescopic expansion may be caused, for example, by a rigid linkage between the thrust end-plate and the inner shaft. One form of rigid linkage may be the outer shaft itself being urged by the thrust end-plate against a reaction end-plate fixed to the second end of the inner shaft.

The spool may, therefore, further comprise a reaction end-plate fixed to the second end of the inner shaft, wherein one end of an outer shaft received on the spindle is urged against the reaction end-plate by the thrust end-plate thrusting against an opposite end of the outer shaft, thereby causing telescopic expansion.

In use, a roll of print media may be wedged in between the thrust end-plate and the reaction end plate. The end-plates cooperate to retain the web on the spool. Moreover, engagement of the thrust end-plate with the spindle, together with the telescopic expansion caused by thrusting abutment of the roll of print media against the reaction end-plate, result in compression and, therefore, radial expansion of both gripping plugs simultaneously.

When the roll of print media is spent or needs to be removed, the thrust end-plate is simply disengaged, which relaxes longitudinal tension along the spindle. This relaxation results in contraction of the gripping plugs and the spent roll of print media can be simply slid off the spindle.

Optionally, the reaction end-plate comprises a connector arm for operatively connecting the spool to a motor. Operative connection may be by, for example, a gear wheel on the connector arm, which intermeshes with a gear wheel on the motor and rotates the spool. Usually, the connector arm also comprises a bearing, allowing free rotation of spool when mounted in a printer. Likewise, the first end of the inner shaft, which typically protrudes from the first end of the spindle, will optionally comprise a bearing, allowing the spool to rotate when mounted in a printer.

BRIEF DESCRIPTION OF THE DRAWINGS

A preferred form of the present invention will now be described in detail, with reference to the following drawings, in which:—

DETAILED DESCRIPTION OF A PREFERRED EMBODIMENT

Figure 1:
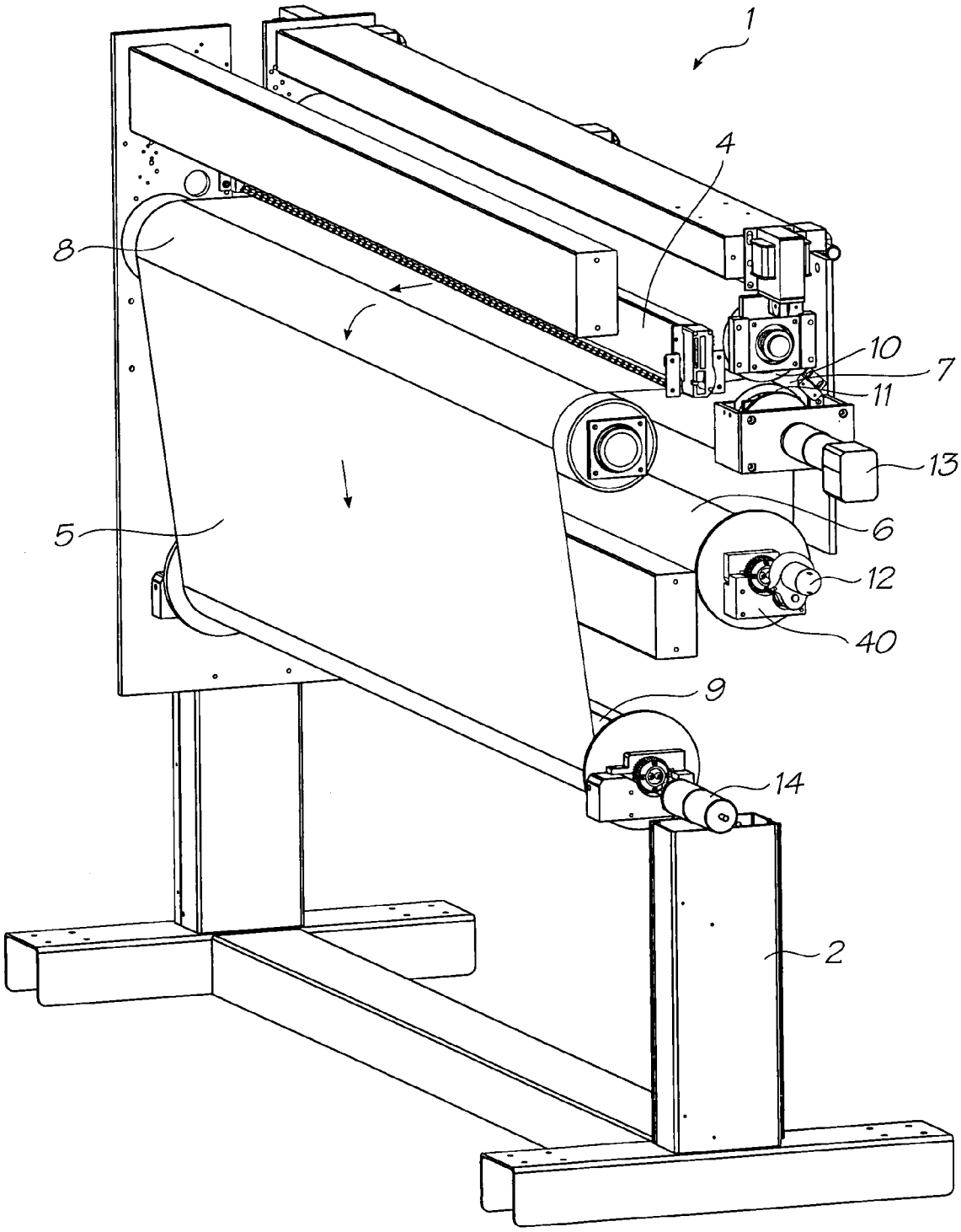
FIG. 1 is a cutaway perspective view of a wide format printer.
Figure 2:
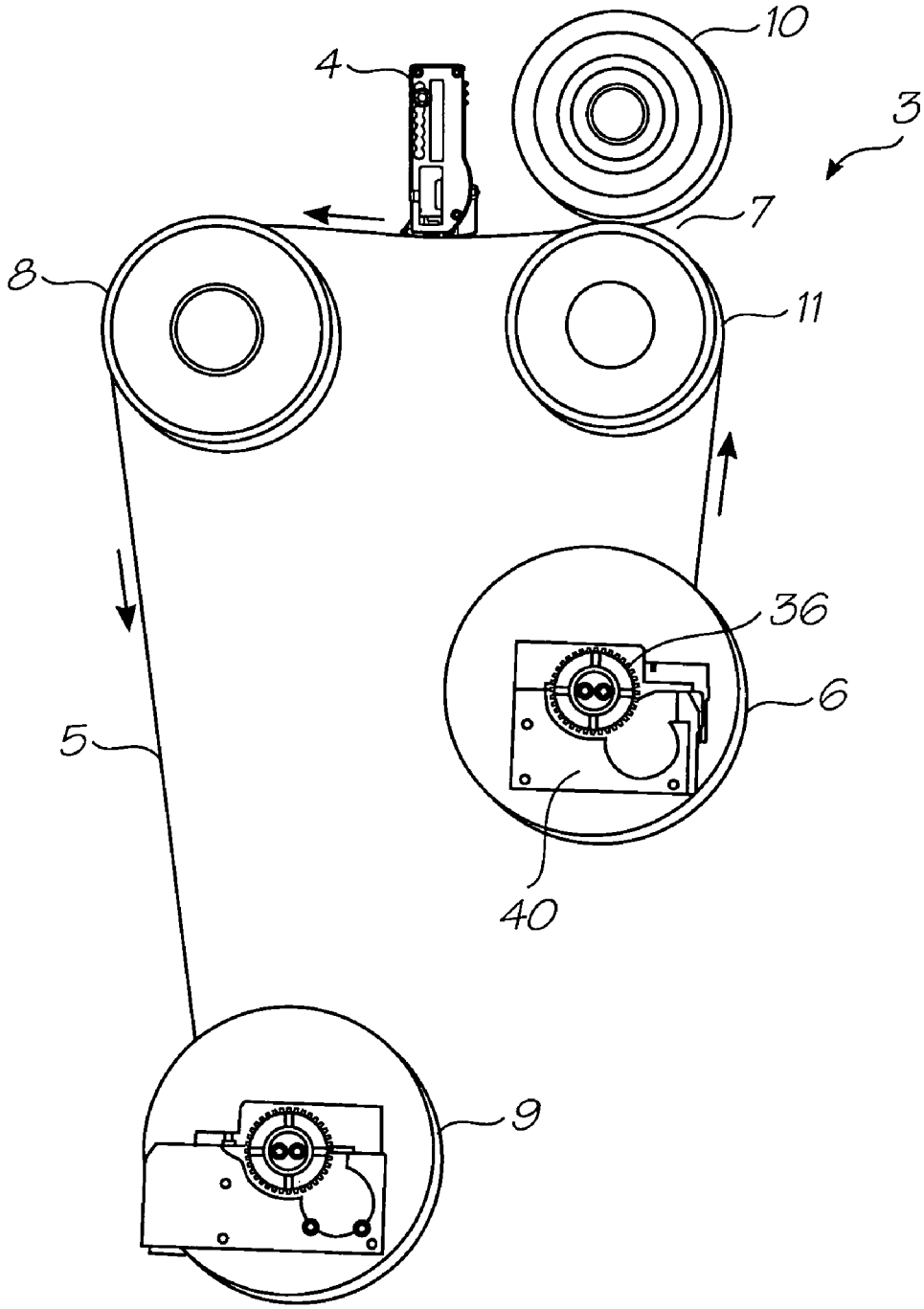
FIG. 2 is a schematic side view of a printhead and feed mechanism for a wide format printer.

Referring to FIGS. 1 and 2 there is a shown a wide format printer 1 comprising a support structure 2, which supports a feed mechanism 3 and a printhead 4. The feed mechanism 3 comprises a system of motorized rollers for feeding a web of print media 5 past the printhead 4. The printhead 4 is a pagewidth inkjet printhead, which ejects droplets of ink onto the web 5 as it is fed through a print zone adjacent the printhead 4. The direction of feed is shown by arrows on the web 5.

FIG. 2 shows in more detail the feed mechanism 3 comprising a supply spool assembly 6, a drive roller system 7, an idle roller 8 and a take-up spool 9. The supply spool assembly 6 comprises a supply spool loaded with a web 5 of print media, which is fed to the drive roller system 7. The drive roller system 7 comprises an upper drive roller 10 in gripping engagement with a lower drive roller 11, the web 5 being fed between the upper drive roller 10 and the lower drive roller 11. From the drive roller system 7, the web is fed past the printhead 4, over the idle roller 8, and onto the take-up spool 9.

Various motors control the feeding of the web 5 through the feed mechanism 3. The supply spool assembly 6 is connected to a braking motor 12, which provides a resistive force and generates tension in the web 5. The main driving force in the feed mechanism 3 is provided by a drive motor 13 connected to the lower drive roller 11. The lower drive roller 11, in combination with the upper driver roller 10 grippingly engaged therewith, drives the web 5 past the printhead 4 at a constant rate.

A take-up motor 14 is connected to the take-up spool 9. The combination of the braking motor 12, the drive motor 13 and the take-up motor 14 maintains constant tension in the web 5 during printing. The maintenance of constant tension in the web 5 is particularly important in high-speed printing in order to avoid paper crumpling and/or poor print quality.

Figure 3:
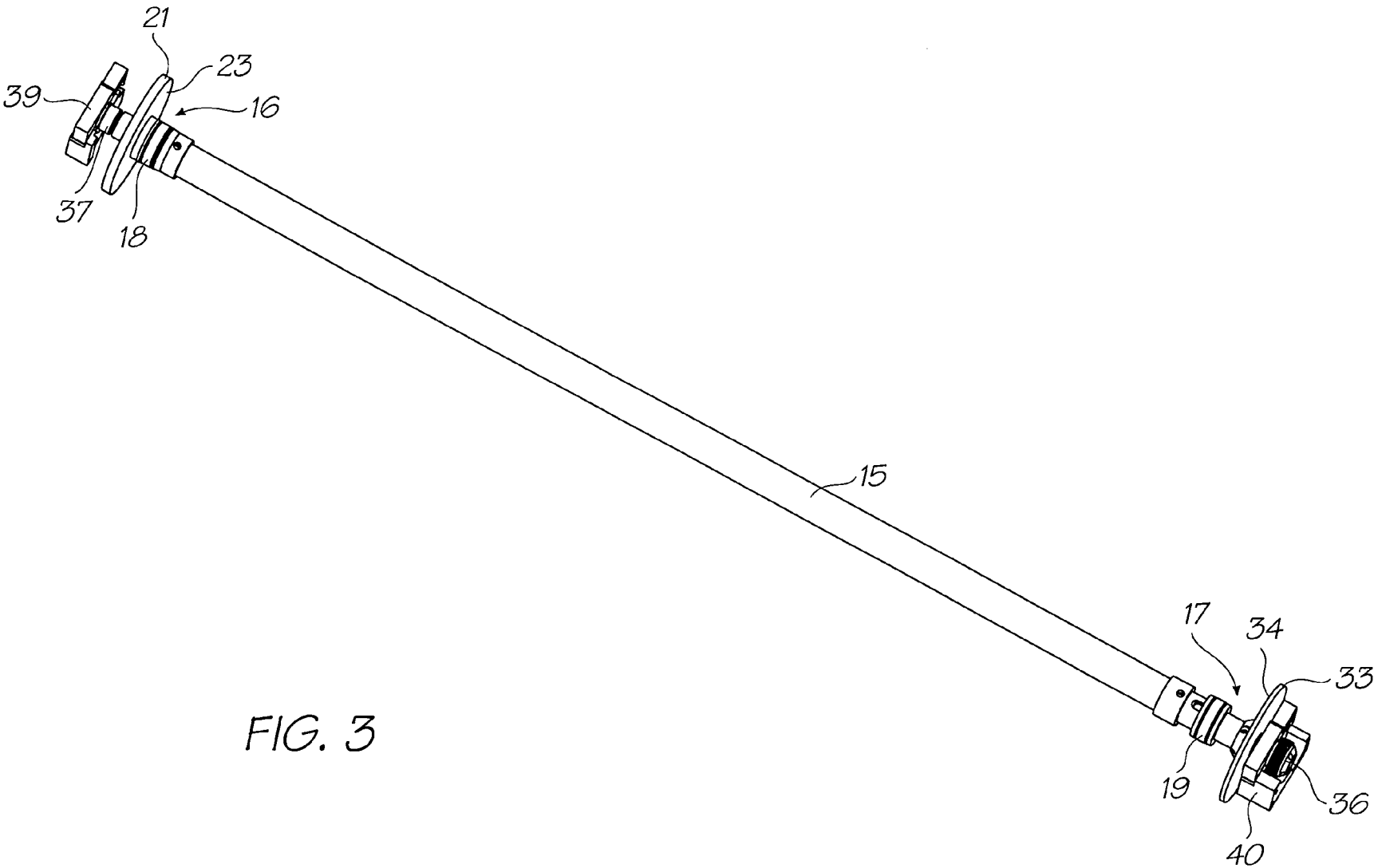
FIG. 3 is a perspective view of the spool according to the invention supported between mountings at its first and second ends.
Figure 4:
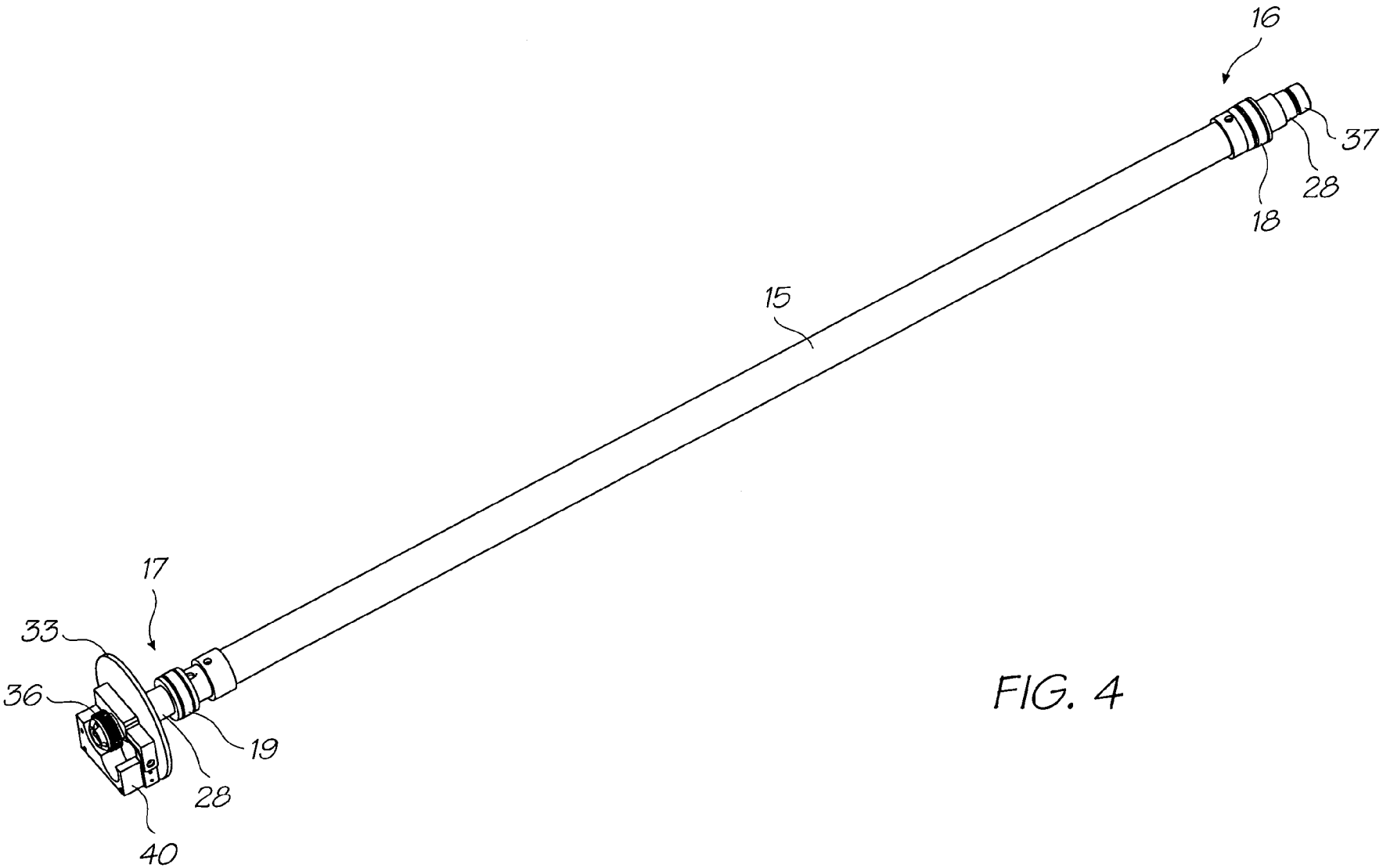
FIG. 4 is a perspective view of the spool according to the invention, with the thrust end-plate removed, supported by a mounting at its second end.

Referring to FIGS. 3 and 4, there is shown the supply spool comprising a spindle 15 for slidingly receiving a roll of print media (not shown). The spindle 15 has a first end 16 and a second end 17, with a first gripping ring 18 mounted on the spindle at the first end and a second gripping ring 19 mounted on the spindle at the second end. The gripping rings 18 and 19 are radially expandable such when the core of a roll of print media (not shown) is received on the spindle 15, radial expansion of the gripping rings urges them into gripping engagement with the inner walls of the core.

The gripping rings 18 and 19 are formed from rubber and are radially expandable by a compression force acting on their annular end surfaces. Hence, the gripping rings 18 and 19 are radially expandable by a compression force acting along the longitudinal axis of the spindle 15.

Figure 5:
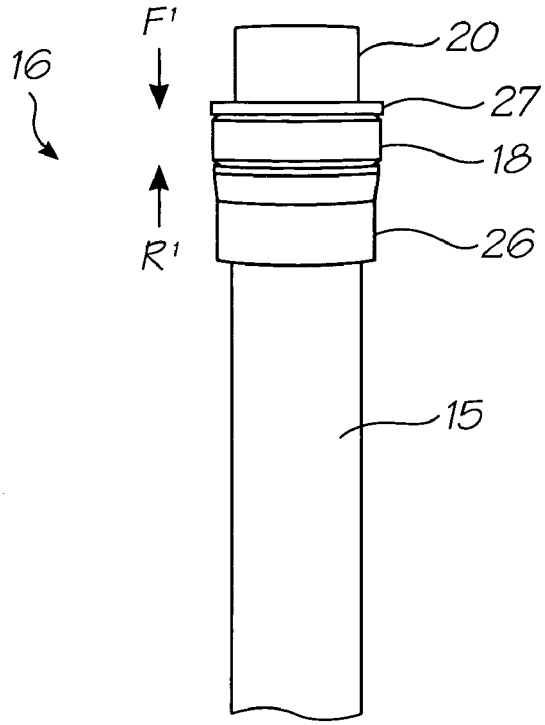
FIG. 5 is a side view of the first end of the spindle.
Figure 6:
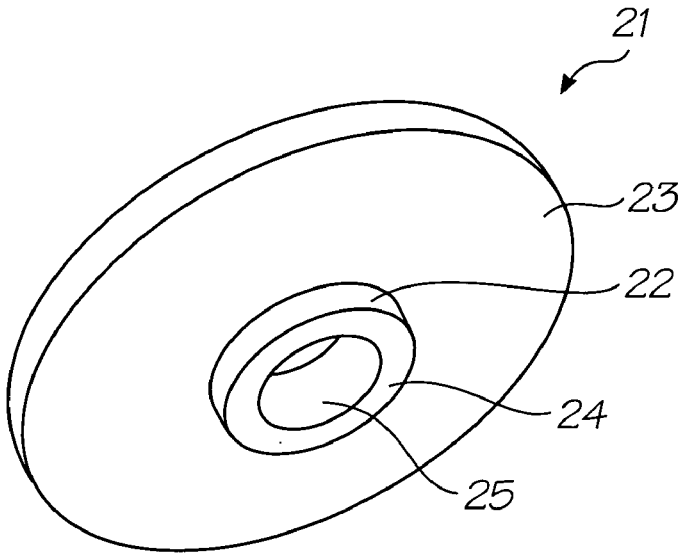
FIG. 6 is a perspective view of the thrust end-plate.

Referring to FIG. 5, there is shown the first end 16 of the spindle 15. This first end the spindle has a threaded portion 20 for threadedly receiving a thrust end plate 21 (FIG. 6). As shown in FIG. 6, the thrust end-plate 21 comprises a thrusting projection in the form of a cylindrical stub 22. The stub 22 has a wide circumferential flange 23 at one end, which forms the body of the thrust end-plate 21. At the other end, the stub 22 has a thrusting annular surface 24. A threaded bore 25 in the thrust end-plate 21 is configured such that the thrust end-plate can be screwed onto the threaded portion 20 of the spindle 15.

Returning to FIG. 5, one annular surface of the first gripping ring 18 bears against an abutment surface formed on a collar 26. The other annular surface of the first gripping ring 18 is adjacent a first washer 27. As the thrust end-plate 21 is screwed onto the threaded portion 20, a compression force $F^1$ urges the thrusting annular surface 24 of the stub 22 against the first washer 27, which, in turn, urges against an annular surface of the first gripping ring 18. A reaction force $R^1$ is provided by the collar 26 and this acts against the other annular surface of the first gripping ring 18. The result is that when the thrust end-plate 21 engages with the first end 16 of the spindle 15, the first gripping ring 18 is compressed and consequently radially expands.

Figure 7:
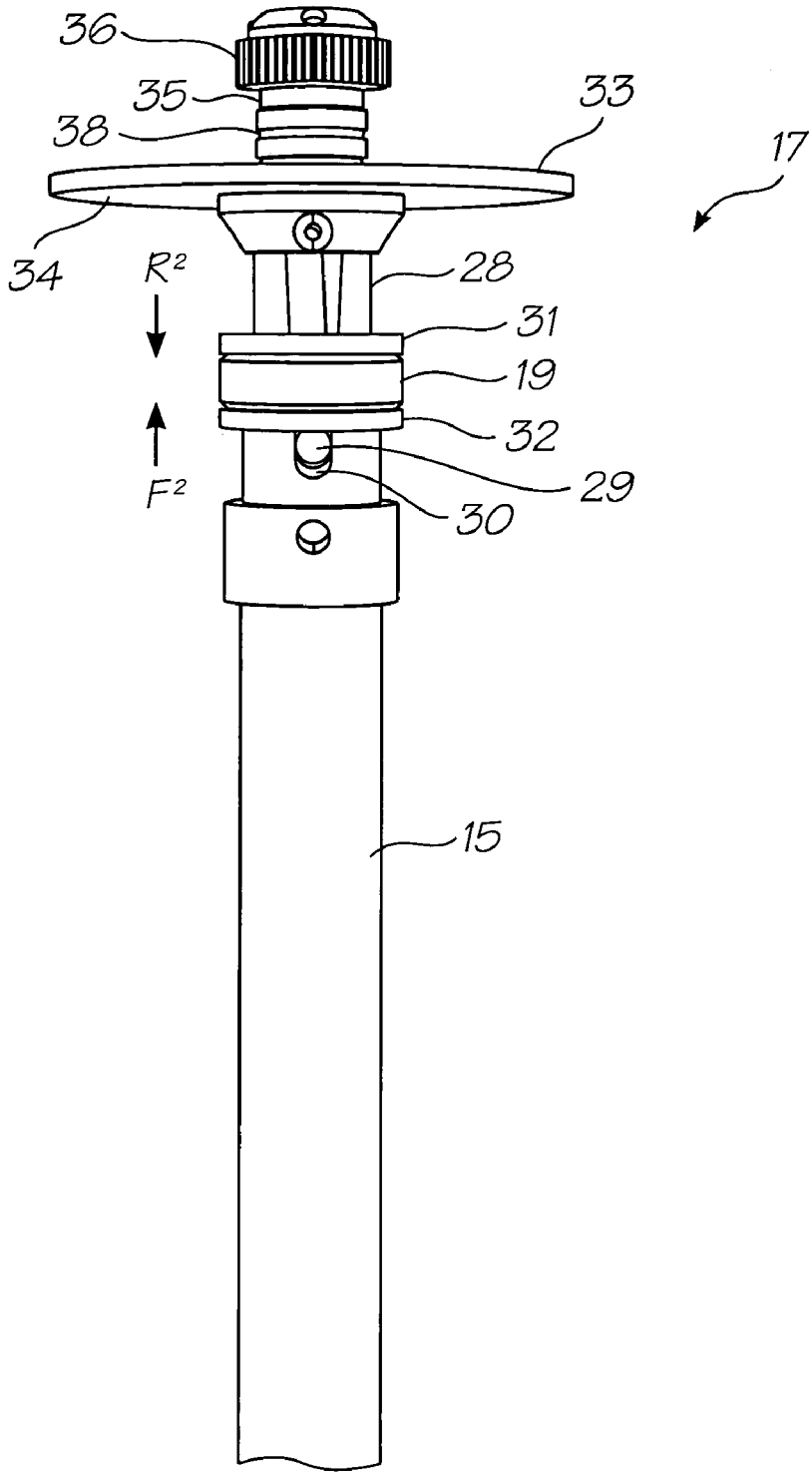
FIG. 7 is a side view of the second end of the spool according to the invention.
Figure 8:
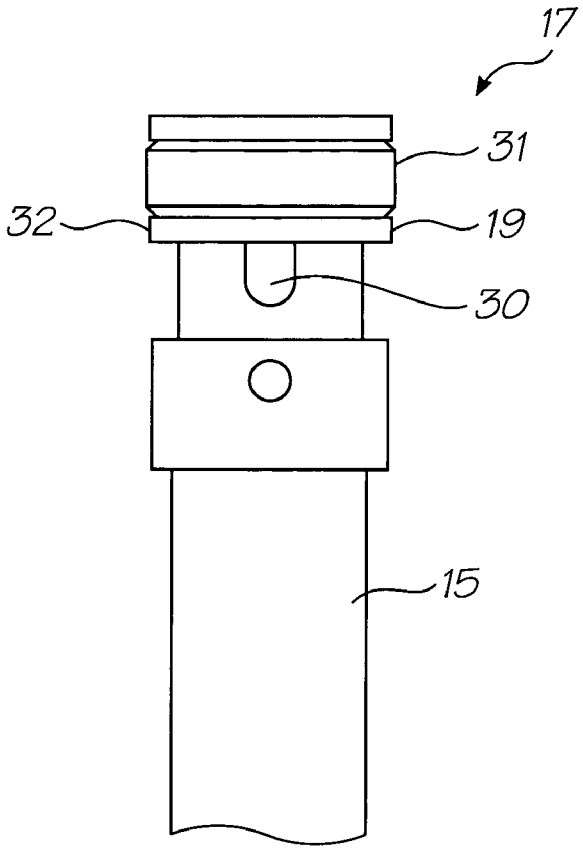
FIG. 8 is a side view of the second end of the spindle.
Figure 9:
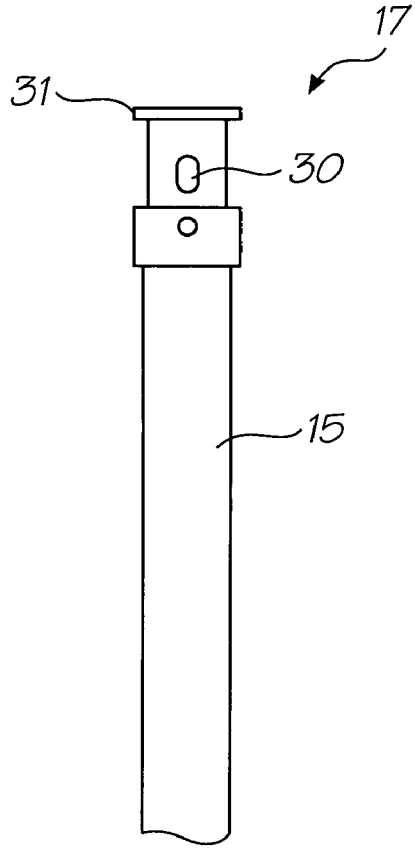
FIG. 9 is a side view of the second end of the spindle with the second gripping ring and second washer removed.

Referring to FIG. 7, at the second end 17 there is shown an inner shaft 28 telescopically engaged with the spindle 15. The inner shaft 28 has a pair of diametrically opposed lugs 29 (only one shown in FIG. 7), which project radially outwards from the inner shaft. Each lug 29 is longitudinally slidingly engaged in a respective complementary slot 30 in the spindle 15. A second abutment surface is provided by the annular surface of a circumferential lip 31 at the second end of the spindle 15.

One annular surface of the second gripping ring 19 bears against the lip 31. The other annular surface of the second gripping ring 19 is adjacent a second washer 32. As the inner shaft 28 telescopically expands from the spindle 15, a compression force $F^2$ urges the lugs 29 against the second washer 32, which, in turn, urges against an annular surface of the second gripping ring 19. A reaction force $R^2$ is provided by the lip 31 and this acts against the other annular surface of the second gripping ring 19. The result is that when the inner shaft 28 telescopically expands from the second end 17 of the spindle 15, the second gripping ring 19 is compressed and consequently radially expands.

As shown in FIG. 7, a reaction end-plate 33 having a flange 34 is fixed to the second end 17 of the inner shaft 28. From FIG. 3, it can be seen that when a roll of print media (not shown) is received on the spindle 15, one end of the roll will bear against the flange 34 on the reaction end-plate 33. As the thrust end-plate 21 is screwed onto the first end 16, its flange 23 thrusts against the other end of the roll. Since the roll is rigid, this thrusting force is transmitted to the flange 34 on the reaction end-plate 33, thereby causing telescopic expansion of the inner shaft 28 from the spindle 15. The overall result is that both gripping rings 18 and 19 are compressed, and consequently radially expanded, when a roll of print media (not shown) is received on the spindle 15 and the thrust end-plate 21 is screwed onto the first end 16 to form a supply spool assembly.

The supply spool assembly thus formed experiences minimal slippage between the roll of print media and the spool due to the radially expanded gripping rings 18 and 19 frictionally gripping the inner walls of the core of the roll of print media (not shown).

Returning to FIG. 7, the reaction end-plate 33 further comprises a connector arm 35 extending from its outer face. The connector arm 35 comprises a gear wheel 36, which operatively connects the spool 6 to a braking motor 12 when the spool is mounted in the printer 1.

To enable the spool 6 to rotate freely when mounted in the printer 1, the spool is provided with a first bearing 37 and a second bearing 38. The first bearing 37 is mounted at the first end 16 of the inner shaft 28 (see FIG. 4). The second bearing 38 is mounted on the connector arm 35, which extends from the reaction end-plate 33 (see FIG. 7). These bearings 37 and 38 cooperatively allow the spool to rotate relative to their respective mountings 39 and 40.

A typical supply spool-loading and printing operation will now be described, which utilizes the advantageous features of the present invention. A roll of print media (not shown) is slid onto a spool having its thrust end-plate 21 removed, as shown in FIG. 4. The thrust end-plate 21 is then screwed onto the first end 16 of the spindle 15, which simultaneously radially expands the gripping rings 18 and 19 into gripping engagement with the core of the print media by the mechanism described above. The supply spool assembly 6 thus formed is mounted into the printer 1, with the reaction end-plate 33 operatively connected to the braking motor 12 via its gear wheel 36.

The printer 1 is set up for printing by manually feeding the web 5 from the supply spool assembly 6, through the drive rollers 10 and 11, past the printhead 4 and over the idle roller 8. The web 5 is then secured to the take-up spool 9 ready for printing. During printing, the feed mechanism 3 feeds the web 5 past the printhead 4 by drawing the web from the supply spool assembly 6 using the drive roller system 7. The supply spool assembly 6 unwinds in an anticlockwise direction as the web 5 is drawn between the drive rollers 10 and 11. Tension in the web 5 between the supply spool and the drive roller system 7 is generated and controlled by the braking motor 12, which imparts a clockwise rotational force onto the reaction end-plate 33 and, hence, onto the spindle 15. The clockwise rotational force is transmitted to the web 5 by frictional engagement of the gripping rings 18 and 19 against the cardboard core of the roll of print media. Hence, the braking force from the braking motor 12 is reliably transmitted to the roll of print media and, hence, the web 5.

Once the roll of print media is used up, the spent cardboard core is removed from the supply spool by simply unscrewing the thrust end-plate 33 and sliding the cardboard core from the spindle 15.

It will, of course, be appreciated that the present invention has been described by way of example only and that modifications of detail may be made within the scope of the invention, which is defined in the accompanying claims.

The invention claimed is:

1. A spool for a printer, said spool comprising:

a spindle for slidingly receiving an outer shaft, said spindle having first and second ends; and a first resiliently deformable gripping ring circumferentially mounted about a first end of said spindle;

a second resiliently deformable gripping ring circumferentially mounted about an opposite second end of said spindle; and a compression mechanism for axially compressing said first and second gripping rings simultaneously, said compression mechanism comprising:

a thrust end-plate releasably engageable with said first end of said spindle;

a first abutment surface, positioned towards said first end of said spindle for providing a reaction against said thrust end-plate, said first gripping ring being mounted between said thrust end-plate and said first abutment surface such that, upon thrusting engagement of said thrust end-plate with said spindle, said first gripping ring is axially compressed against said first abutment surface;

an inner shaft telescopically engaged in said spindle, said inner shaft having first and second ends corresponding to said first and seconds ends of said spindle;

at least one lug projecting radially outwards from said inner shaft, said at least one lug being longitudinally slidingly engaged in a complementary longitudinal slot in said spindle; and a second abutment surface positioned at a second end of said spindle for providing a reaction against said at least one lug, said second gripping ring being mounted between said at least one lug and said second abutment surface such that, upon telescopic expansion of said inner shaft relative to said spindle, said second gripping ring is axially compressed against said second abutment surface by said at least one lug, a reaction end-plate fixed to said end of said inner shaft, a roll of print media received about said spindle, said roll of print media being mounted between and engaged with said thrust end-plate and said reation end-plate;

wherein one end of said roll of print media is urged against said reation end-plate by said thrust end-plate thrusting against an opposite end of said roll of print media, thereby causing said telescopic expansion, and wherein said axial compression causes radial expansion of said gripping rings, thereby urging said gripping rings into gripping engagement with said outer shaft received on said spindle.

2. The spool of claim 1, wherein said roll of print media has a cardboard core engaged with said thrust end-plate and said reaction end-plate.

3. The spool of claim 2, wherein said gripping rings are formed from a frictional material for frictional gripping engagement with said core.

4. The spool of claim 1, wherein said first abutment surface is a surface of a collar positioned towards said first end of said spindle.

5. The spool of claim 1, wherein said first end of said spindle is threaded and said thrust end-plate is threadedly engagable therewith.

6. The spool of claim 1 further comprising a first washer positioned between said first gripping ring and said thrust-end-plate, wherein said washer distributes evenly a compression force from said thrust end-plate onto said first gripping ring.

7. The spool of claim 1, wherein said second abutment surface is formed on a circumferential lip at said second end of said spindle.

8. The spool of claim 1 comprising a pair of diametrically opposed lugs, each projecting radially outwards from said inner shaft, and each being longitudinally slidingly engaged in the respective complementary longitudinal slot in said spindle.

9. The spool of claim 1 further comprising a second washer positioned between said second gripping ring and said at least one lug, wherein said second washer distributes evenly a compression force from said at least one lug onto said second gripping ring.

10. The spool of claim 1, wherein said longitudinal sliding is telescopic expansion of said inner shaft relative to said spindle.

11. The spool of claim 1, wherein said reaction end-plate comprises a connector arm for operatively connecting said spool to a motor.

12. The spool of claim 1, which is take-up spool or a supply spool for a printer.

13. A wide format printer comprising:

a printhead; and a feed mechanism for feeding a web of print media past said printhead, said feed mechanism comprising:

a supply spool;

a take-up spool; and a take-up motor operatively connected to said take-up spool, wherein said supply spool and/or said take-up spool is a spool according to claim 1.

* * * * *